United States Patent [19]

Jones, deceased et al.

[11] Patent Number: 4,947,822

[45] Date of Patent: Aug. 14, 1990

[54] CROSSBOW ARROW STABILIZER

[76] Inventors: Leland L. Jones, deceased, late of Shreveport, La.; Dovie D. Scherer, administrator, 4339 Booth St., Kansas City, Kans. 66103

[21] Appl. No.: 342,558

[22] Filed: Apr. 24, 1989

[51] Int. Cl.[5] ..... F41B 5/00

[52] U.S. Cl. ..... 124/41.1; 124/25

[58] Field of Search ..... 124/24 R, 25, 26, 27, 124/41 R, 41 A

[56] References Cited

U.S. PATENT DOCUMENTS

| | | | |
|---|---|---|---|
| 3,483,857 | 12/1969 | Jones | 124/41 R X |
| 3,581,729 | 6/1971 | Jones | 124/25 |
| 3,788,299 | 1/1974 | Mathews | 124/35 R |
| 4,206,740 | 6/1980 | Lydon | 124/25 |
| 4,722,318 | 2/1988 | Yankey | 124/25 |

*Primary Examiner*—Randolph A. Reese

*Assistant Examiner*—John A. Ricci

*Attorney, Agent, or Firm*—John M. Harrison

[57] ABSTRACT

A crossbow arrow stabilizer which is designed to stabilize an arrow in loaded configuration in a crossbow and includes an arrow stabilizer block slidably mounted in the stabilizer block housing of the crossbow forestock in concert with a pair of spring blocks carrying spaced, internally-mounted coil springs. The arrow stabilizer block and the spring blocks can be raised in concert against the bias of the coil springs to receive an arrow shaft which is positioned in the forestock between the coil springs, in order to apply pressure on the arrow shaft and align the arrow shaft securely, yet releasably, in the forestock. Release of the bow string by the trigger in the crossbow in conventional fashion forces the arrow from the arrow stabilizer block and allows the arrow stabilizer block to seat on the bottom of the stabilizer block housing by operation of the coil spring.

4 Claims, 1 Drawing Sheet

CROSSBOW ARROW STABILIZER

BACKGROUND OF THE INVENTION

1. Field of the Invention

This invention relates to crossbows and more particularly, to a crossbow arrow stabilizer which is designed to stabilize an arrow in a crossbow in firing configuration to facilitate greater accuracy in firing the arrow. In a preferred embodiment, the crossbow arrow stabilizer of this invention is characterized by an arrow stabilizer block located in the stabilizer block housing of a crossbow forestock, wherein the arrow stabilizer block is attached to a pair of oppositely-disposed spring blocks provided with internally-mounted coil springs. When an arrow is loaded in the crossbow and is inserted in the forestock of the crossbow, the arrow head and shaft extends between the arrow stabilizer block and the bottom portion of the stabilizer block housing against the bias of a pair of coil springs having one end mounted in the spring blocks and the opposite ends attached to the stabilizer block housing, in order to securely, yet removably position the arrow in the forestock for firing. Firing of the arrow by pulling the trigger of the crossbow and releasing the bow string in conventional fashion forces the arrow rapidly from beneath the arrow stabilizer block to the target and allows the arrow stabilizer block to return to its original position against the bottom of the stabilizer block housing by means of the two springs located in the spring blocks.

One of the problems realized in operation of crossbows is that of precisely positioning an arrow in the crossbow such that the arrow is stabilized regardless of the relative position of the crossbow. For example, under circumstances where the crossbow is loaded and the arrow is fired downwardly at a target, the arrow has a tendency to slide forward in the forestock ahead of the bow string, which results in inaccurate firing of the arrow. Furthermore, under circumstances where the crossbow is tilted to the side or at an angle with respect to the ground in order to fire at a target, the arrow may displace slightly in the forestock, again resulting in poor accuracy.

2. Description of the Prior Art

U.S. Pat. No. 3,483,857, dated Dec. 16, 1969, to L. L. Jones, entitled "Crossbow", details a crossbow structure having a stock and an elongated barrel with a bore provided with longitudinally spaced L-supporting portions and an enlarged intermediate portion which cooperates with a loading opening in the rear portion that communicates with and opens inwardly from the bore, whereby arrows are loaded from the rear of the bore. The intermediate portions of the bow are clamped adjacent to the muzzle end of the barrel below the bore and the barrel has longitudinally extending, opposed slots in which the bow string moves and when in cocked position, the string is engaged with a sear that moves transversely of the plane of the string and extends into a recess, whereby the string may not be released until the sear is retracted. The sear is connected by a link to a trigger pivotally mounted on the stock, with a trigger guard and safety lug positionable between the trigger and guard, to prevent accidental retractive movement of the trigger. The barrel has separable portions and the bore may be formed by an insert of material which is substantially unaffected by climatic conditions. U.S. Pat. No. 3,581,729, dated June 1, 1971, to Leland L. Jones, includes a crossbow structure for projecting an elongated, feathered arrow having a butt portion and an elongated barrel with a bow secured to a forward or muzzle end of the elongated barrel. The barrel has a bore provided with longitudinally spaced, resiliently supported arrow-positioning members therein and longitudinal slots at each side of the bore for travel of a bowstring therealong. The crossbow structure has a trigger member and linkage operatively connected to a sear for selectively holding and releasing the bow string. A cam safety is positioned to be selectively moved into and out of engagement with a trigger member and an elongated safety pin is positioned to be selectively moved into and out of engagement with a sear, for holding or releasing the bow string. The stock has an aperture therein for access to a gripping portion adjacent the trigger member. An upwardly-biased, arrow-positioning member is positioned at both the breech and muzzle ends of the barrel.

It is an object of this invention to provide a new and improved crossbow arrow stabilizer which is adapted to engage the arrow in a crossbow and stabilize the arrow prior to release of the arrow from the crossbow.

Another object of the invention is to provide a crossbow arrow stabilizer which is characterized by a spring-loaded block located in the forward end of the forestock at the stabilizer block housing for receiving, engaging, supporting and stabilizing an arrow prior to release of the arrow from the crossbow.

Still another object of the invention is to provide a crossbow arrow stabilizer for crossbows, which stabilizer includes an arrow stabilizer block located in a stabilizer block housing of the crossbow forestock and adapted to engage an arrow loaded in the crossbow, a pair of oppositely-disposed spring blocks attached to the arrow stabilizer block, with a pair of coil springs located in the spring blocks for providing tension on the arrow while the arrow is loaded in the crossbow prior to firing the arrow from the crossbow.

SUMMARY OF THE INVENTION

These and other objects of the invention are provided in a new and improved crossbow arrow stabilizer which is characterized in a preferred embodiment by an arrow stabilizer block located in the forward portion of the forestock of a crossbow, a pair of spring blocks attached to each side of the arrow stabilizer block and a pair of coil springs provided in the spring blocks for biasing the arrow stabilizer block against an arrow shaft of an arrow located in the crossbow, in order to stabilize the arrow in the crossbow prior to firing of the arrow, regardless of the orientation of the crossbow.

BRIEF DESCRIPTION OF THE DRAWING

The invention will be better understood by reference to the accompanying drawing, wherein.

DESCRIPTION OF THE PREFERRED EMBODIMENT

Figure 1:
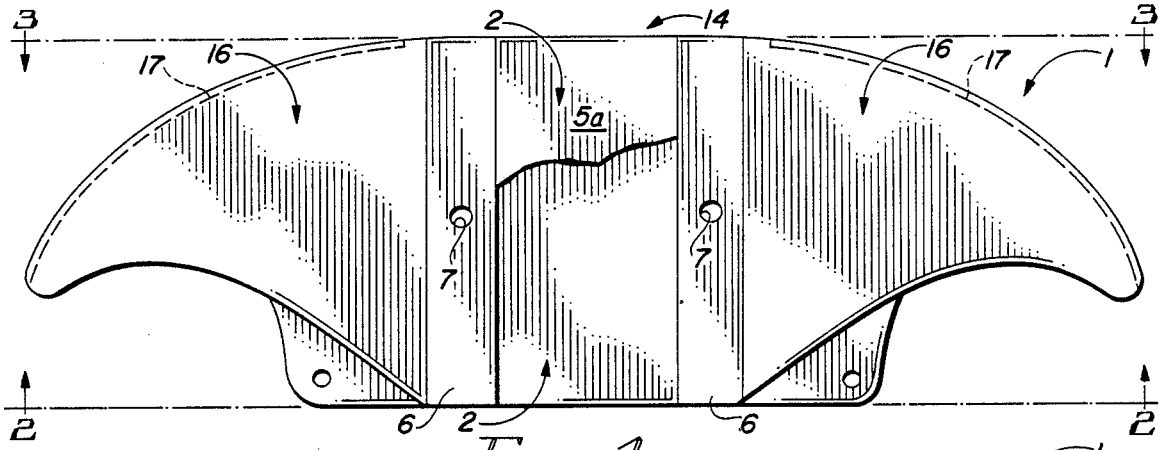
FIG. 1 is a top view, partially in section, of a preferred embodiment of the crossbow arrow stabilizer of this invention, with the bow arms removed for clarity.
Figure 2:
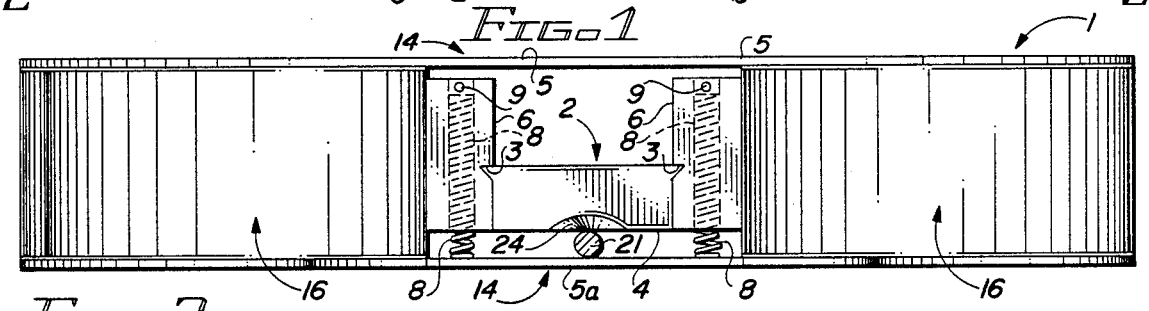
FIG. 2 is a rear view of the crossbow arrow stabilizer illustrated in FIG. 1, with an arrow inserted in the stabilizer block housing.
Figure 3:
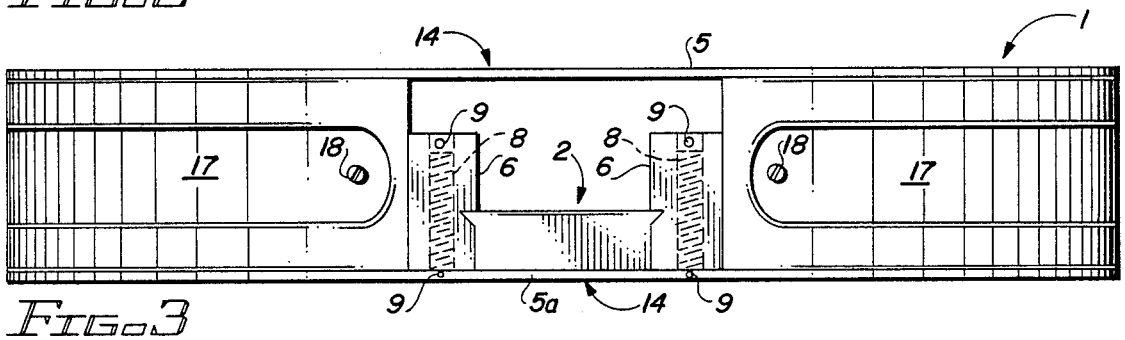
FIG. 3 is a front view of the crossbow arrow stabilizer illustrated in FIGS. 1 and 2 after the arrow is released from the crossbow.

Referring to FIGS. 1 and 2 of the drawing, the crossbow arrow stabilizer of this invention is generally illustrated by reference numeral 1 and is seated in a stabilizer block housing 14, located at the arrow-ejection end of the forestock 12 of a crossbow 10. As illustrated in FIG. 1, the housing cap 5 of the stabilizer block housing 14 is removed to illustrate the arrow stabilizer block 2 and the housing bottom 5*a*. In a most preferred embodiment of the invention the crossbow arrow stabilizer 1 includes the arrow stabilizer block 2, fitted with a pair of stabilizer block tabs 3 on each side thereof and having a flat arrow contact surface 4, as illustrated in FIG. 2. An engaging slot 24 is shaped in the rear bottom end of the arrow stabilizer block 2 for receiving the tip of an arrow during loading of the arrow, in order to raise the arrow stabilizer block 2 into functional configuration, as hereinafter further described. The projecting stabilizer block tabs 3 engage oppositely-disposed, spaced spring blocks 6 that are positioned on opposite sides of the arrow stabilizer block 2. The spring blocks 6 are designed to slide vertically upwardly and downwardly in the stabilizer block housing 14, between the walls thereof and between the housing cap 5 and housing bottom 5*a*, against the bias of a pair of coil springs 8, the upper ends of which are located in parallel spring apertures 7, provided in the spring blocks 6, respectively, as illustrated in FIG. 1. Spring pins 9 extend through the spring blocks 6 and the housing bottom 5*a* of the stabilizer block housing 14, and engage the upper and lower ends of the springs 8 in transverse relationship, respectively, to retain the springs in the spring apertures 7 and on the housing bottom 5*a*, respectively. Accordingly, the spring blocks 6 and arrow stabilizer block 2 slide in concert upwardly and downwardly in the stabilizer block housing 14, responsive to loading and releasing of an arrow in the crossbow 10, as hereinafter further described. The crossbow arrow stabilizer 1 is thusly mounted in the stabilizer block housing 14 in the forward portion of the hollow forestock 12 of the crossbow 10, which forestock 12 is fitted with a stock 11 for seating against the shoulder of a user, in conventional fashion. A forestock slot 13 is provided in the forestock 12 for receiving the center of a bowstring 20, the ends of which are secured to the bow arms 15, and an arrow having an arrow shaft 21 is inserted in the breech 19 of the hollow forestock 12 between the arrow stabilizer block 2 and the stabilizer block housing 14, to load the crossbow 10, as further hereinafter described. When the arrow shaft 21 is located in the forestock 12 in firing position as illustrated in FIG. 2, the bowstring 20 is retracted against the tension in the bow arms 15. The bow arms 15 are typically mounted on the arm supports 16 in the arm slots 17 of the forestock 12 by means of arm bolts 18, and the bowstring 20 is fitted in a nock (not illustrated) provided in the fletching end of the arrow shaft 21. The arrow is now ready for firing from the crossbow 10 and the tension applied to the front portion of the arrow shaft 21 by operation of the springs 8 in each of the spring blocks 6, stabilizes the arrow shaft 21 between the arrow contact surface 4 of the arrow stabilizer block 2 and the housing bottom 5*a* of the stabilizer block housing 14, in order to prevent the arrow shaft 21 from moving from right to left or sliding outwardly of the forestock 12 and the stabilizer block housing 14, when the crossbow 10 is positioned in various aiming configurations. The arrow is fired from the crossbow 10 by pulling the trigger 22 located inside the trigger guard 23 and releasing the tension in the bow arms 15, to accelerate the bow string 20 and expel the arrow shaft 21 from beneath the arrow stabilizer block 2 and out of the stabilizer block housing 14. After firing of the arrow, the arrow stabilizer block 2 returns to the configuration illustrated in FIG. 3, with the arrow contact surface 4 lying against the housing bottom 5*a* of the stabilizer block housing 14, by operation of the springs 8.

Figure 4:
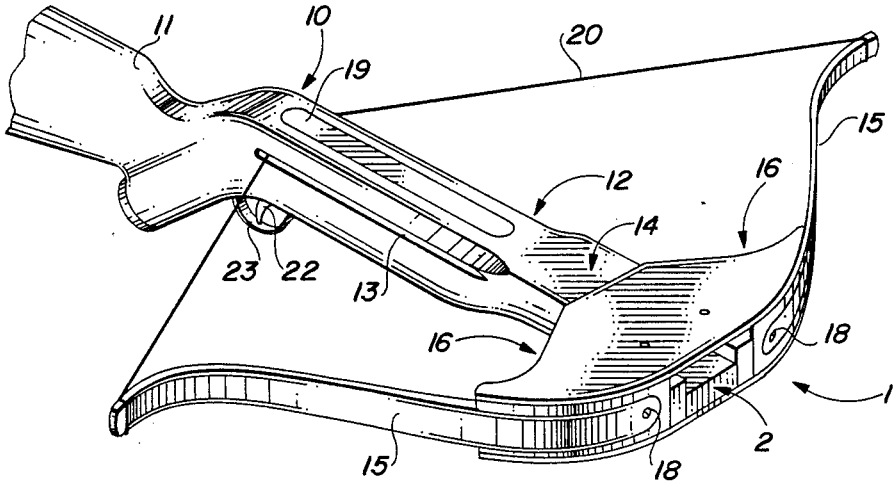
FIG. 4 is a perspective view of a crossbow fitted with crossbow arms and the crossbow arrow stabilizer illustrated in FIGS. 1–3.

Referring again to FIGS. 2 and 4 of the drawing, after extending the bowstring in locked configuration for release by the trigger 22 in conventional fashion as illustrated in FIG. 4, loading of an arrow in the crossbow 10 is effected as follows: the arrow is initially inserted in the breech 19 and extended through the hollow forestock 12, until the arrow tip (not illustrated) engages the engaging slot 24, shaped in the arrow stabilizer block 2, as illustrated in FIG. 2. The downwardly depending angle of the arrow as it is loaded into the hollow forestock 12 through the breech 19, causes the arrow tip to engage the engaging slot 24 in angular relationship. Forward pressure applied to the arrow then forces the arrow stabilizer block 2 and the companion spring blocks 6 upwardly against the bias in the springs 8, thus allowing the arrow shaft 21 to seat beneath the arrow stabilizer block 2, as illustrated in FIG. 2.

It will be appreciated by those skilled in the art that the crossbow arrow stabilizer of this invention operates to prevent the arrow shaft 21 of a loaded arrow from shifting in the stabilizer block housing 14 of the crossbow 10, regardless of the position or attitude of the crossbow 10. Accordingly, the crossbow 10 can be loaded, carried for an indefinite period of time in loaded configuration in any desired position or attitude, aimed at a target, and fired, without fear of inadvertently displacing the arrow shaft 21 from its loaded configuration.

It will be further appreciated that while the arrow stabilizer block 2 is illustrated as a separate element from the adjacent spring blocks 6, these elements may be combined in a single stabilizer member, as desired. Accordingly, while the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A crossbow stabilizer comprising a pair of spring blocks slidably provided in said crossbow, an arrow stabilizer block carried by said spring blocks and a pair of coil springs having one end carried by said spring blocks, respectively, with the opposite end of said coil springs attached to the crossbow, for biasing said arrow stabilizing block against an arrow loaded in the crossbow.

2. The crossbow arrow stabilizer of claim 1 further comprising a vertical opening provided in each of said spring blocks, and wherein said one end of said coil springs extend into said opening, respectively, for mounting said one end of said coil springs to said spring blocks, respectively.

3. A crossbow arrow stabilizer for removably stabilizing an arrow in a crossbow, comprising a pair of spring blocks vertically disposed in slidable relationship in the arrow-discharge end of said crossbow, an arrow stabilizer block disposed between said spring blocks in fixed relationship a pair of coil springs having one end attached to the arrow discharge end and the opposite end of said coil springs carried by said spring blocks, whereby said spring blocks are adapted to engage the arrow when the arrow is loaded in the crossbow responsive to the bias of said coil springs and the arrow is released from beneath said arrow stabilizer block responsive to firing of the crossbow.

4. The crossbow arrow stabilizer of claim 3 further comprising a vertical bore provided in each of said spring blocks for receiving said opposite end of said coil springs, respectively, and pin means extending through said vertical bore, said opposite end and said one end of said coil springs, respectively, for securing said opposite end of said coil spring in said vertical bore and said one end of said coil springs to said arrow discharge end, respectively.

* * * * *